United States Patent [19]

Orr

[11] Patent Number: 4,739,457

[45] Date of Patent: Apr. 19, 1988

[54] ILLUMINATING DEVICE SUPPORT

[76] Inventor: Allie E. Orr, 103 Stonewall Rd., Warner Robins, Ga. 31093

[21] Appl. No.: 895,374

[22] Filed: Aug. 11, 1986

[51] Int. Cl.[4] ..... F21U 21/10

[52] U.S. Cl. ..... 362/287; 362/190; 362/202; 362/277; 362/306

[58] Field of Search ..... 362/190, 202, 285, 287, 362/421, 426, 427, 382, 277, 306; 248/168, 166, 106, 170, 175, 351, 359, 434, 439

[56] References Cited

U.S. PATENT DOCUMENTS

| | | | |
|---|---|---|---|
| 2,137,881 | 11/1938 | Margulies | 362/202 |
| 2,602,880 | 7/1952 | Engelhardt et al. | 362/282 |
| 4,399,498 | 8/1983 | Bacevius | 362/190 X |
| 4,521,834 | 6/1985 | Orr | 362/281 X |

*Primary Examiner*—Margaret A. Focarino

[57] ABSTRACT

There is disclosed an illuminating device support to be used primarily in combination with illuminating devices having an adjustable light reflector for the purpose of providing the device with prepositional support, or suspension, in almost any given area of device usage such that the device need not be hand held, leaving the hands free for other activity, which comprises of flanges attached to either side of the device casing and extending downward, terminating in a flange bottom edge, said flanges configured to receive and latch the reflector into a stored position, said flanges having a rotor shaft bearing to rotatably receive the rotor shaft on a Z axis, providing the rotor and attached leg with 360° of Z axis rotation; a rotor having a rotor shaft and leg shaft bearings, said leg shaft bearings to rotatably receive the leg shaft on a Y axis, providing the leg with about 180° of Y axis rotation; legs having a leg shaft on one end and a hooking means on the opposite end, wherein the legs may be rotated, as required to accommodate the device area of usage, to various detent positions on the Y and Z axes to provide device support or suspension.

8 Claims, 9 Drawing Sheets

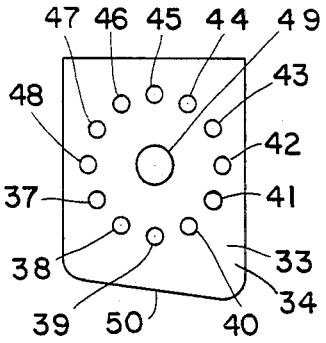
FIG. 18
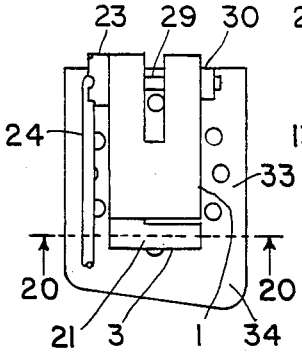
FIG. 19
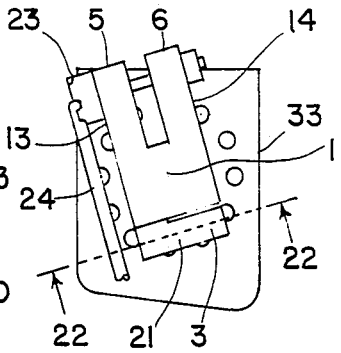
FIG. 21
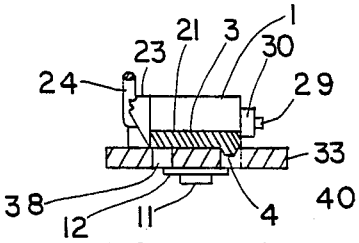
FIG. 20
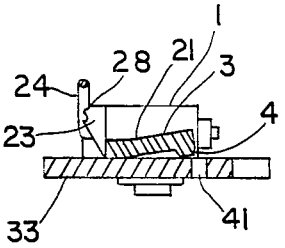
FIG. 22
FIG. 23
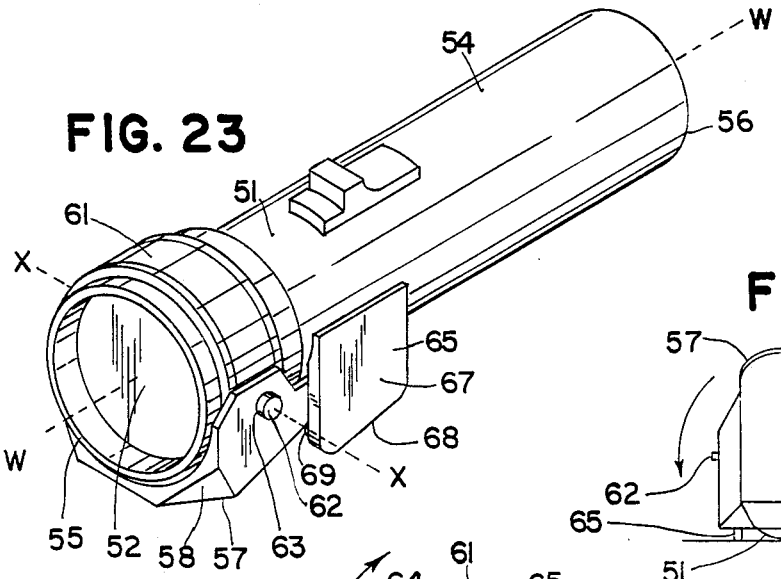
FIG. 24b
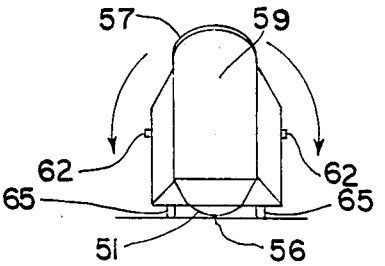
FIG. 24a
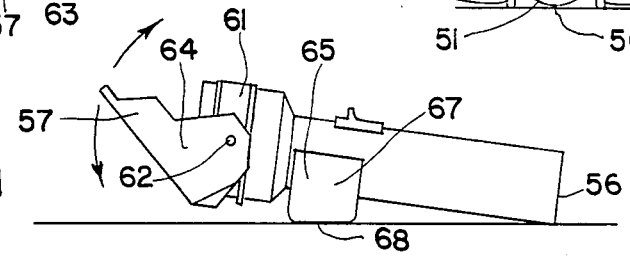

ILLUMINATING DEVICE SUPPORT

FIELD OF THE INVENTION

This invention relates to illuminating device supports and particularly to supports for illuminating devices having adjustable light reflectors which allow the device and the reflector to be prepositioned to illuminate a desired area.

CROSS REFERENCE TO RELATED APPLICATIONS

Whereas this invention is applicable to illuminating devices in general, the illuminating device of the preferred embodiment of this invention is equipped with an adjustable light reflector like, or similar to, that described in this inventor's U.S. Pat. No. 4,521,834, titied "ADJUSTABLE REFLECTOR FOR ILLUMINATING DEVICES." Because of the interaction between the said reflector and the preferred embodiment of this invention, a brief description of the reflector mechanism and several drawings, based on U.S. Pat. No. 4,521,834, are subsequently provided.

DISCUSSION OF PRIOR ART

Heretofore, illuminating device supports encompassed many various designs, including wire racks, tripods, two leg supports, magnets, clamps, wire rings, and many other configurations, but none have as many features as this invention. In order to avoid repetition, these features are listed as objects and may be seen by referencing the OBJECTS section.

OBJECTS

It is an object of this invention to provide a support for illuminating devices that will allow the device to be prepositioned to illuminate a desired area such that the device need not be hand held, thereby leaving the hands free for other activity. It is also an object to provide a support for illuminating devices equipped with adjustable light reflectors that will allow the prepositioning of both the reflector and the illuminator. .Furthermore it is an object to provide a support that will not interfere with the operation of the reflector mechanism that will also provide a convenient storage place for the reflector when the reflector and/or the illuminating device is not being used.

It is another object to provide a single, or common, support mechanism design that will accomodate illuminators having reflectors, and.those not, in order to reduce manufacturing costs.

It is also an object to provide a support mechanism of such diverse capability that an illuminating device may be supported in almost any area regardless of the proliferation of interfering objects, surface slope, size, irregularity or other obstacles blocking the emitted light or placement of the device.

It is an object to provide a support having a hooking capability in order to suspend, or hang, the device from protrusions, wires, nails, edges, etc., thereby increasing the utility of the illuminating device.

It is a further object to provide a support that offers no interference when the illuminator is used in the hand held mode nor to add substantially to the size of the device during that period.

It is still another object to provide an illuminating device support that is of simple but rugged design and at the same time, very easy to operate.

Further objects and advantages of this invention will become apparent from a consideration of the drawings and ensuing description thereof.

DETAILED DESCRIPTION OF DRAWINGS

Figure 3A:
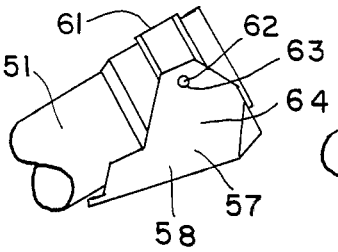
Figure 3B:
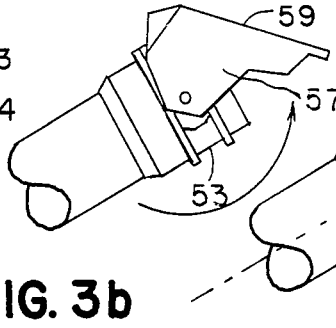
Figure 3C:
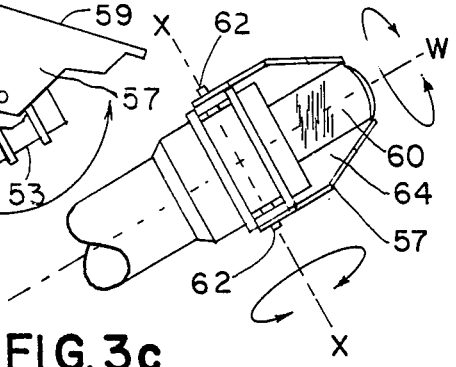

FIGS. 3*a*, 3*b* and 3*c* are views of the prior art reflector in various positions.

Figure 4A:
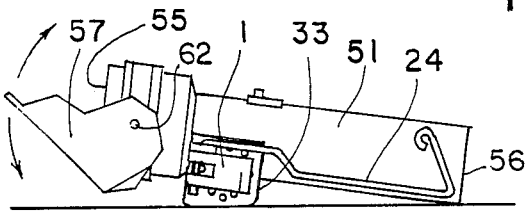
Figure 4B:
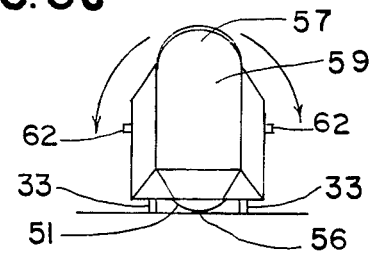

FIGS. 4*a* and 4*b* are side and front views of the invention in the flange support position.

Figure 5A:
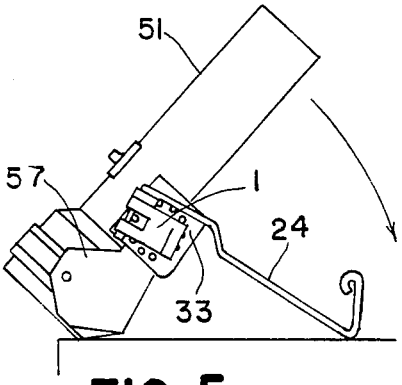
Figure 5B:
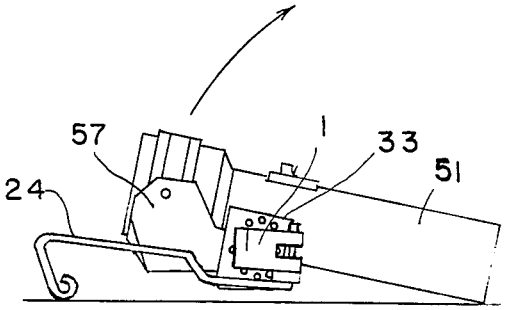
Figure 5C:
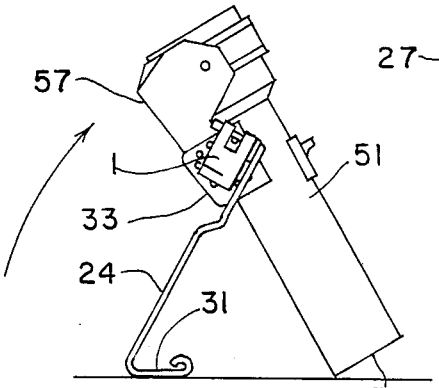

FIGS. 5*a*, 5*b* and 5*c* are side views showing various leg supporting positions.

Figure 6:
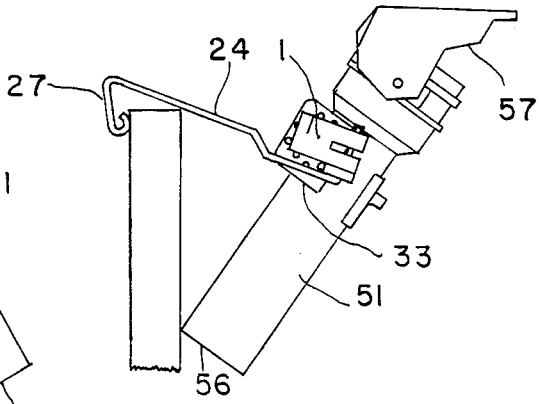
Figure 7:
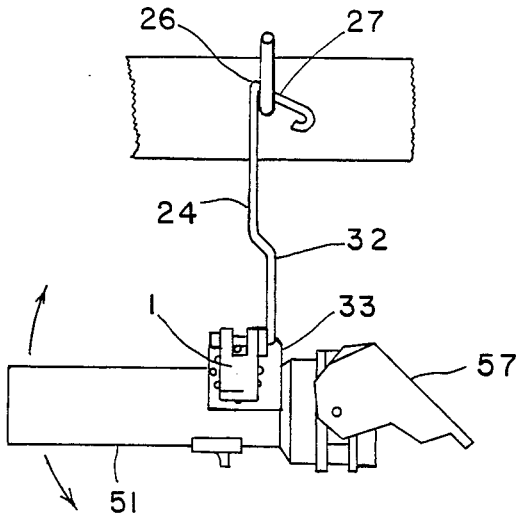

FIGS. 6 and 7 are side views showing leg suspension positions.

Figure 8:
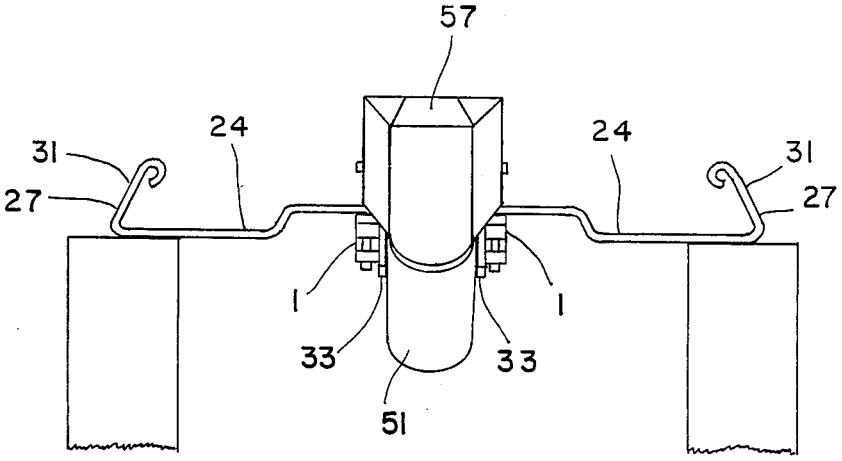

FIG. 8 is a frontal view showing the legs in tangential position.

Figure 9:
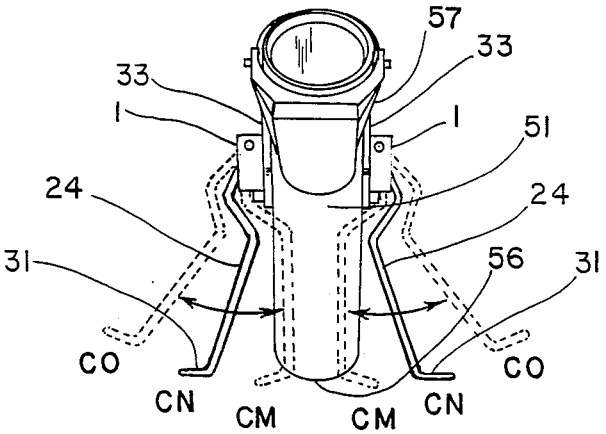

FIG. 9 is a frontal view showing the variable leg width capability of the invention.

Figure 10:
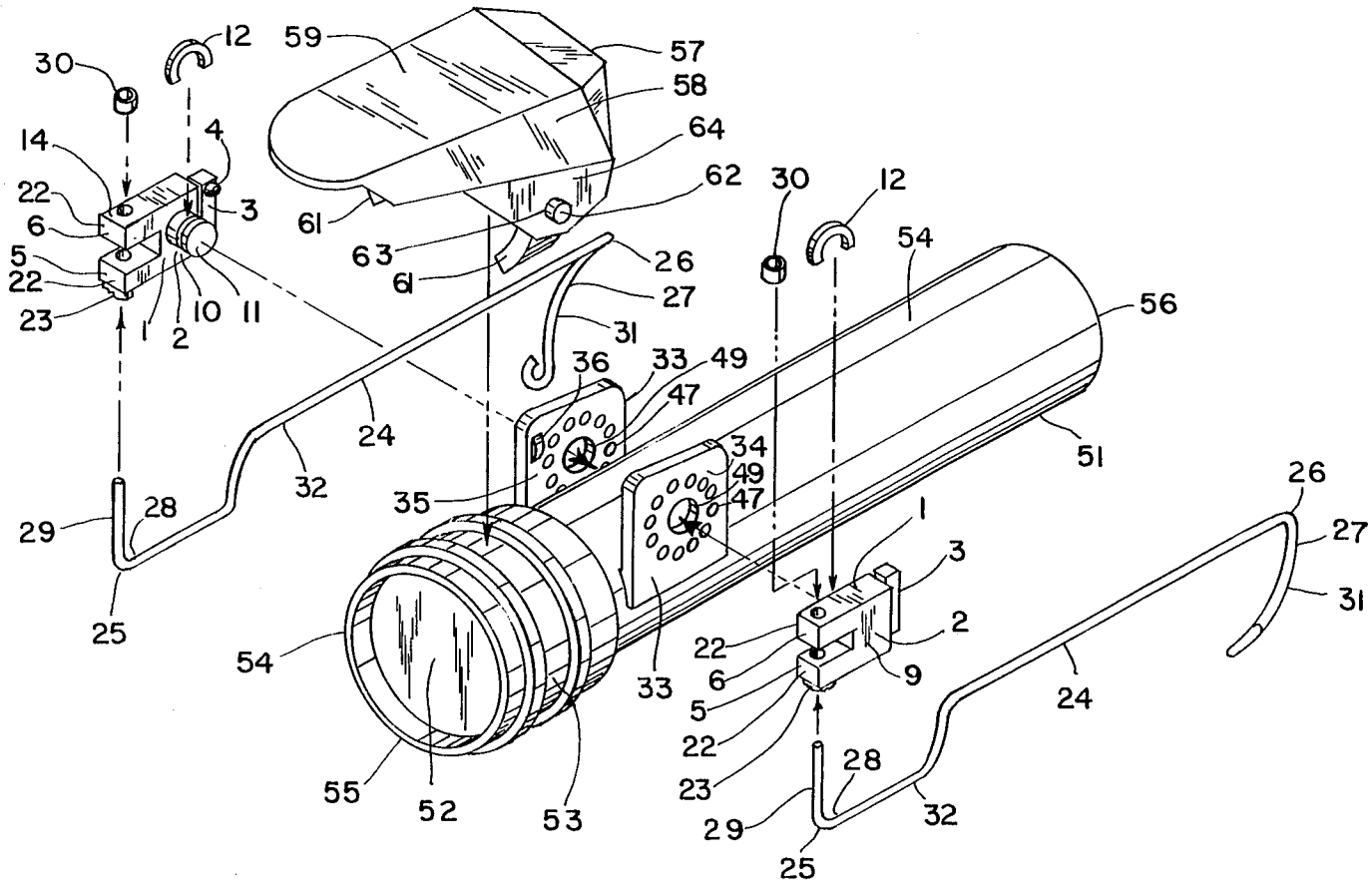

FIG. 10 is disassembled perspective bottom view of the invention showing how the components fit together.

Figure 11A:
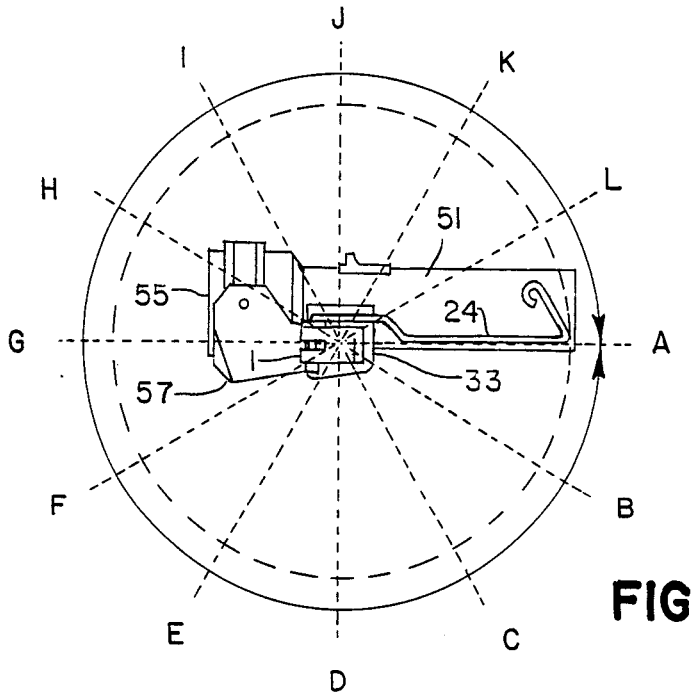
Figure 11B:
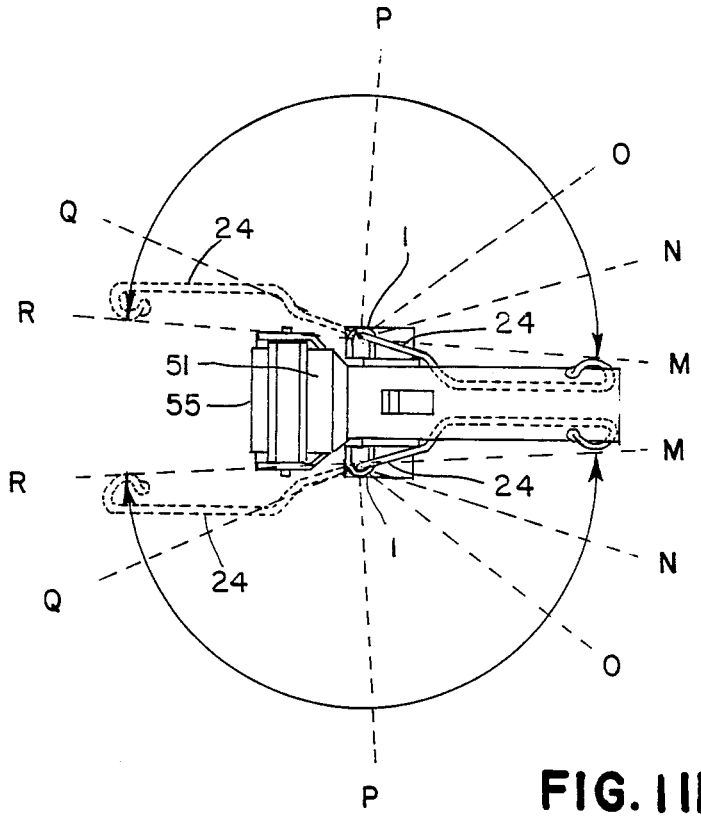

FIGS. 11*a* and 11*b* are side and bottom views showing the leg rotational range of the Z and Y axes respectively.

Figures 12, 13, 14, 15A, 15B:
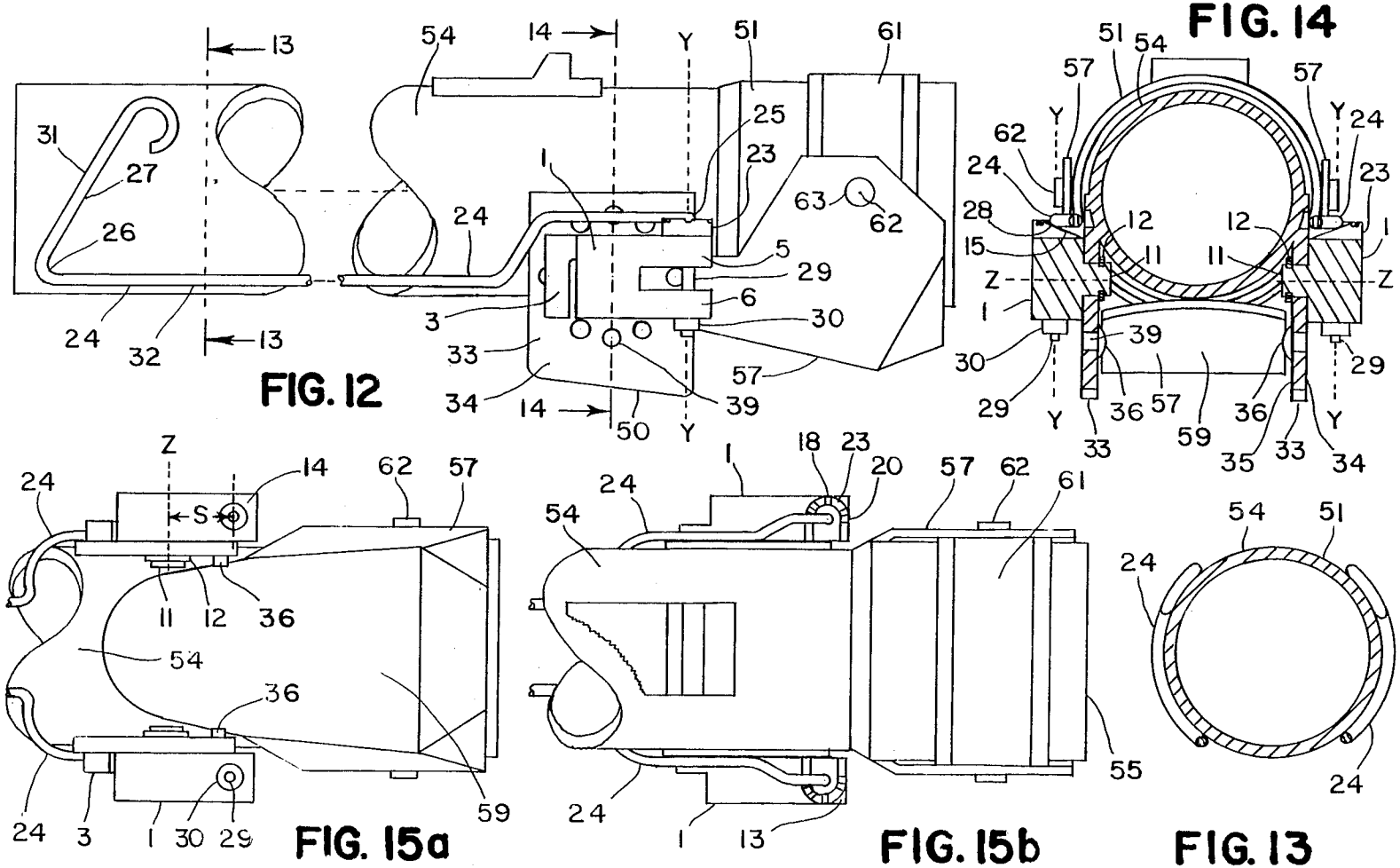

FIG. 12 is a truncated side view of the invention showing the legs in stow position and reflector in stored position.

FIG. 13 is a transverse sectional view along the lines 13—13 of FIG. 12

FIG. 14 is a transverse sectional view along the lines 14—14 of FIG. 12.

FIGS. 15*a* and 15*b* are bottom and top partial views respectively, showing the legs in stow position and reflector in stored position.

Figure 16A:
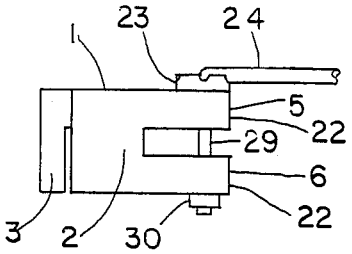
Figure 16B:
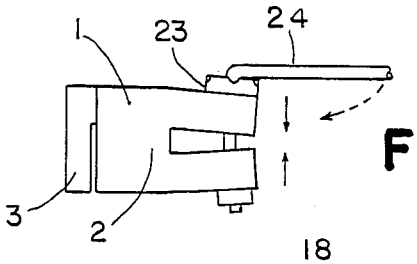

FIGS. 16*a* and 16*b* are side views of a rotor and leg assembly showing rotor deformation as the leg is rotated out of a leg groove.

Figure 17:
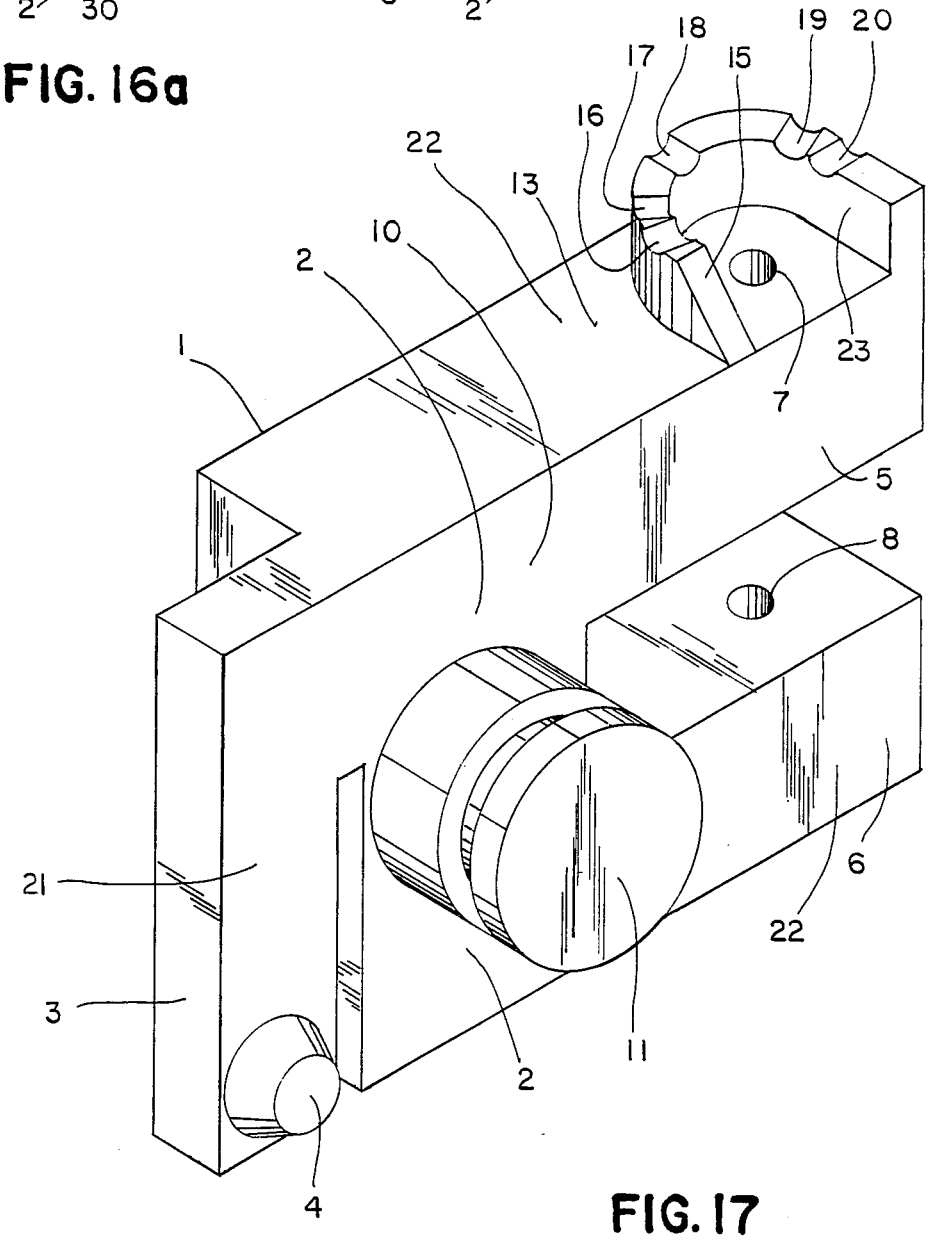

FIG. 17 is an enlarged perspective view of a rotor.

FIG. 18 is a side view of a flange.

FIG. 19 is a side view of a flange and rotor assembly with the rotor in a detent position.

FIG. 20 is a transverse sectional view along the lines 20—20 of FIG. 19 showing the rotor wiper arm in a detent position.

FIG. 21 is a side view of a flange and rotor assembly with the rotor between detent positions.

FIG. 22 is a transverse sectional view along the lines 22—22 of FIG. 21 showing the rotor wiper arm between detent positions.

FIG. 23 is a perspective view of an alternative form of the invention with the reflector in stored position.

FIGS. 24*a* and 24*b* are side and front views of the alternative form in the flange support position.

Figure 25:
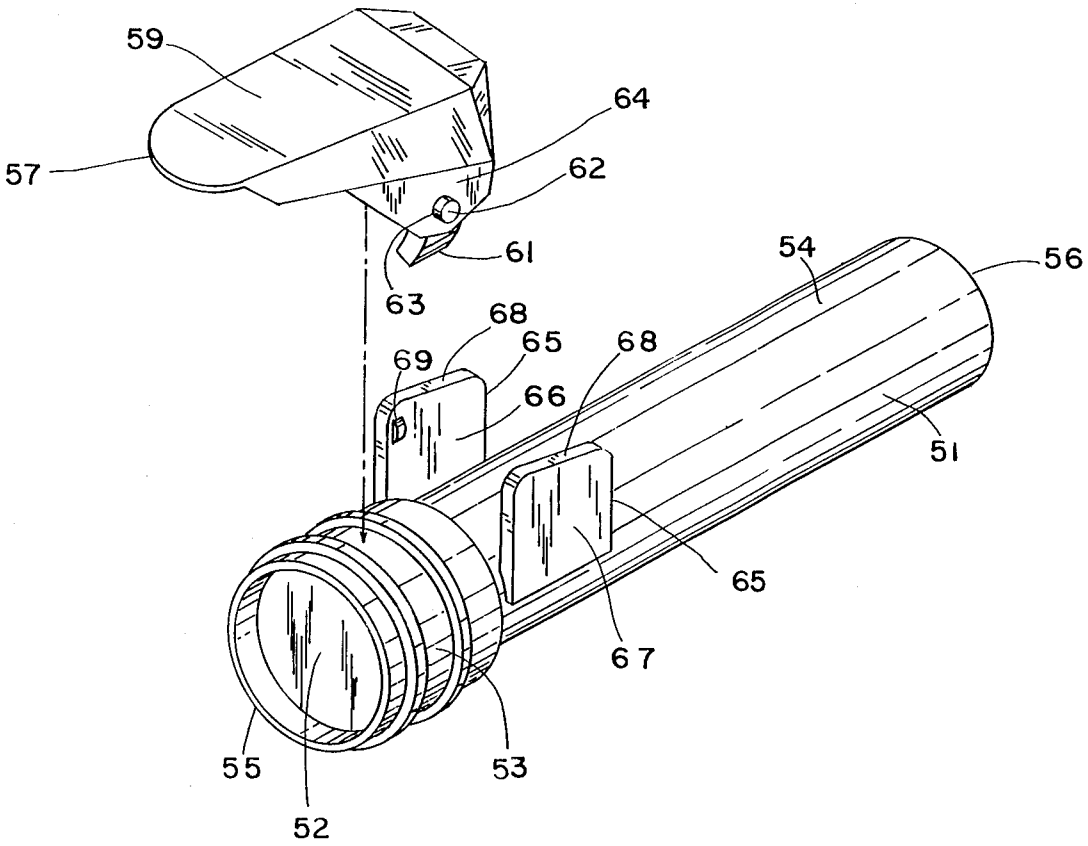

FIG. 25 is a disassembled perspective bottom view of the alternative form of the invention showing how the components fit together.

DETAILED DESCRIPTION OF THE INVENTION

The instant invention is termed illuminating device support and, basically, the invention, or elements thereof, may be used for supporting, or suspending any type of illuminating device which may be aimed in a particular direction or must be held in a certain position. In the preferred embodiment, however, the illuminating device of the instant invention is a flashlight. More specifically, the flashlight may, or may not, be equipped with an adjustable light reflector inasmuch as a single configuration of this invention will accommodate both types. However, the best application of this invention is with an illuminating device that is equipped with an adjustable light reflector inasmuch as the coupling of this invention with a device having a reflector provides a far more effective illuminating means that with a device not so equipped. For the remainder of the description herein, it will be assumed that the device of the instant invention is a flashlight equipped with an adjustable reflector. However, in accordance with the previous discussion, this is not a necessity.

Although the reflector mechanism involved with this invention is not necessarily restricted to any particular design, the reflector involved with the preferred embodiment of the instant invention is of the basic design defined in this inventor's U.S. Pat. No. 4,521,834, which is shown in FIGS. 3*a* through 3*c*. The three main elements of the reflector (57) are the hood (58), collar means (61) and the collar means receiver (53). The hood includes the top surface (59), reflective surface (60), arms (64) and collar shaft bearings (63).

Observing FIGS. 1, 2, 3*a*, 3*b* and 3*c*, notice that the hood of the reflector contains a reflective surface (60) located on the under side of the top surface (59), wherein arms (64) extend away from the top surface and terminate in collar shaft bearings (63). The collar means (61) is rotatably attached to the collar means receiver (53), wherein the collar means receiver is attached to the front end (55) of the device casing (54), the said collar means receiver being attached near the device light emitting source (52). The collar means has rotational capability on the W axis, the said W axis being hereby defined as the illuminating device longitudinal axis, wherein the W axis is also generally in alignment with the light beam emitted by light emitting source, said W axis extending through the front end (55) and the rear end (56) of the illuminating device (51). The collar shafts (62), located on either side of the collar means, rotatably receives the collar shaft bearings (63), providing the hood with rotational capability on the X axis, wherein the X axis is generally perpendicular to the W axis. The reflector, therefore, has rotational, or adjustment, capability on both the X and W axes, providing a means whereby light can be reflected into almost any direction.

FIG. 3*a* shows the reflector in a stored, or unused position, where the reflector is out of the way of the light emitting source and is resting against the bottom of the casing. This defines the hood stow position.

FIG. 3*b* shows the reflector being deployed for use by being rotated on the X axis, exposing the reflective surface to the emitted beam.

FIG. 3*c* shows the reflector rotational capability on both the W and X axes.

One interacting involvement of this invention with the prior art adjustable reflector is shown in FIGS. 12, 14 and 15*a* in that the space between the flanges (33) provides a convenient and protected area for the reflector to be stored. Furthermore, the flange inside surfaces (35) contains a reflector latching means (36) to latch the reflector into the stored position. Another factor of reflector accomodation is that once the reflector is deployed, this invention offers no interference to the normal usage of the reflector.

The three main elements of the preferred embodiment of the instant invention, as seen in FIG. 10, are the flanges (33), rotors (1) and the legs (24). Referencing FIGS. 1, 2, 10, 11*a* and 11*b*, it can be seen that the leg is rotatably attached to the rotor and rotates on the Y axis, and that the rotor is rotatably attached to the flange and rotates on the Z axis. This arrangement provides the legs with rotational capabilities on both the Y and Z axes. Each of the two legs has its own Y and Z axes of rotation, as each of the two legs are rotationally indePendent of the other. In addition, each leg has a Y axis position holding means and a Z axis position holding means whereby each leg may be rotated to a particular position, and that position held, or retained.

Figure 1:
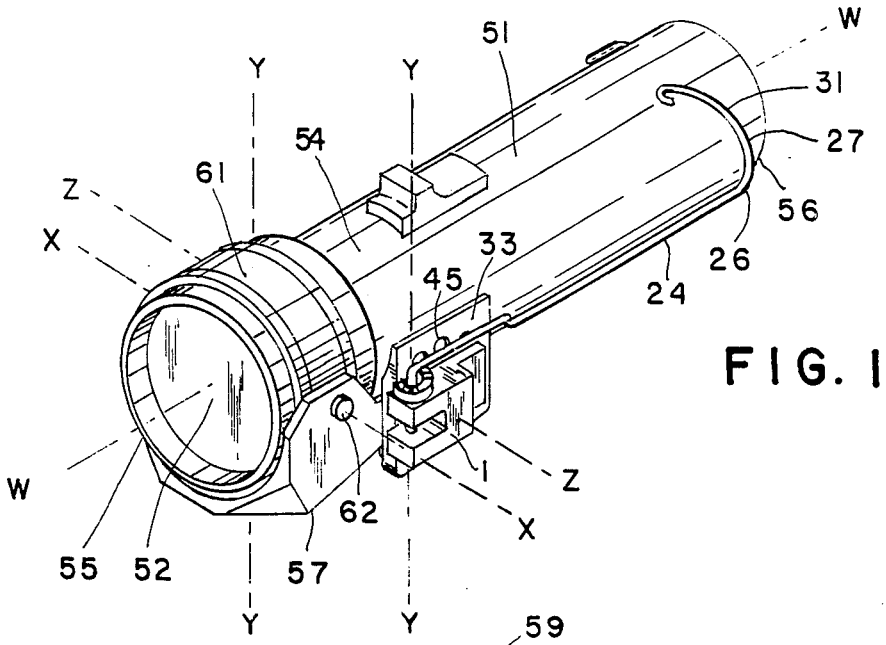
FIG. 1 is a perspective view of an illuminating device equipped with this invention with the legs in the stow position and the reflector in the stored position.

FIG. 1 shows the illuminating device with the legs in the stow, or unused, position. In this position, the device may be operated hand held, or stored away. Note that the invention does not add significantly to the overall size and that the flanges are located sufficiently forward of the casing rear end to allow the casing to be grasped by the hand on that portion of the casing rearwards of the flanges.

In the preferred embodiment, when the legs are deployed for use, the leg will encounter twelve detent, or held positions as it is rotated the full 360° on the Z axis, as shown in FIG. 11*a*. The leg will encounter six detent positions as it is rotated the approximate range of 180° on the Y axis, as shown in FIG. 11*b*. FIGS. 11*a* and 11*b* do not show all the possible leg positions. Actually, each leg has 72 different positions, 12 Z times 6 Y positions. It is noteworthy to state at this point that the number of detent positions designed into this invention, on both the Y and Z axes, can be varied greatly and still produce a very useful invention. However, in order to fulfill the Patent requirement of describing an invention that could be made by one familiar with the art, a precise design is being offered in the form of the preferred embodiment which, of course, requires the choosing of an exact number of detent positions. Continuing on, the twelve Z axis detent positions (which is a function of the Z axis position holding means) are positions A, B, C, D, E, F, G, H, I, J, K and L, as seen in FIG. 11*a*. The six Y axis detent positions (which is a function of the Y axis position holding means) are M, N, 0, P, Q and R, as seen in FIG. 11*b*. When a leg is deployed for use, it will be in both a Y axis and a Z axis detent position. For example, when the legs are rotated to the nominal tripod position, as shows in FIG. 2, each leg will be rotated to the C detent position on the Z axis, and the N position on the Y axis or, more simply stated, position CN.

Although the leg Y axis and Z axis position holding means utilized in the preferred embodiment, as just discussed, is finite and the positions precisely placed, the invention would also work if the number of positions was infinite, allowing the legs to be adjusted to any position within their range of rotation. One design that would provide infinite leg positions is where the Y and Z axes shafts are friction fitted into their respective bearings, wherein the inherent resistance to rotation would provide the Y axis and Z axis position holding means. Both finite and infinite types have advantages and disadvantages. Certainly, an illuminating device having infinite leg positions would come nearer accommodating whatever device placement restrictions that may exist in any given environment. On the other hand, infinite leg adjustment capability requires greater adjustmant force since the legs must be able to retain their position at any given Point throughout the total rotational range whereas the finite detent positioning capability only requires an inordinate effort when rotating the leg out of a detent position. Also, detent positioning provides for a quicker rotation to a desired leg position since the number of choices are finite, not infinite. Furthermore, since the illuminating device of the instant invention is equiped with an adjustable reflector, which can reflect light into almost any direction, the advantage of infinite leg adjustment is reduced. It is for these reasons that the preferred embodiment utilizes Y axis and Z axis position holding means that provides finite detent leg adjustment. However, this invention is not limited to either the finite or infinite leg position holding means as either will provide leg position retaining capability.

Within the finite leg position holding means concept is another variable worthy of discussion, and that is the number of detent positions. Obviously, the greater the number of detent positions, the greater the capability to provide leg support for any given situation. On the other hand, the fewer the detent positions, the simpler the leg deployment operation as the operator doesn't have as many choices. (Actually only two positions are required to provide a very useful invention (though less adaptable) and that is the stow position and the nominal tri-pod.) Another consideration in the number of detent positions is the illuminating device application. For example, an aircraft mechanic would need more detent positions to accommodate very small congested areas of usage than a farmer would working in his barn. Therefore, this invention is not limited to the exact number of detent positions previously described for the preferred embodiment as more, or less, would still provide a very useful invention.

The Z axis detent positions shown in FIG. 11*a* assumes that the leg is held in the Y axis N detent position as the leg is rotated the full 360° on the Z axis. The Y axis detent positions shown in FIG. 11*b* assumes that the leg is held in the Z axis A detent position as the leg is rotated the approximate range of 180° on the Y axis.

The locus of the leg end as it travels the 360° on the Z axis is shown by the dashed circle in FIG. 11*a*. Notice in FIG. 15*a*, which shows the legs in the stow position, that the Y axis is forward the Z axis by a distance S. Referring back to FIG. 11*a*, if the leg was rotated to position R on the Y axis prior to rotating the leg the 360° on the Z axis, then the leg end would travel a locus that extends beyond the dashed circle by a distance of about 2S. Therefore, by rotating the leg into detent position R, or even Q, an extended reach position of the leg is established and is hereby defined as such. The extended reach position provides the capability of the leg to reach more distant objects to hang onto, utilizing the hooking means (27) located on the leg end, or to provide increased device elevation when the device is in a tripod position.

Figure 2:
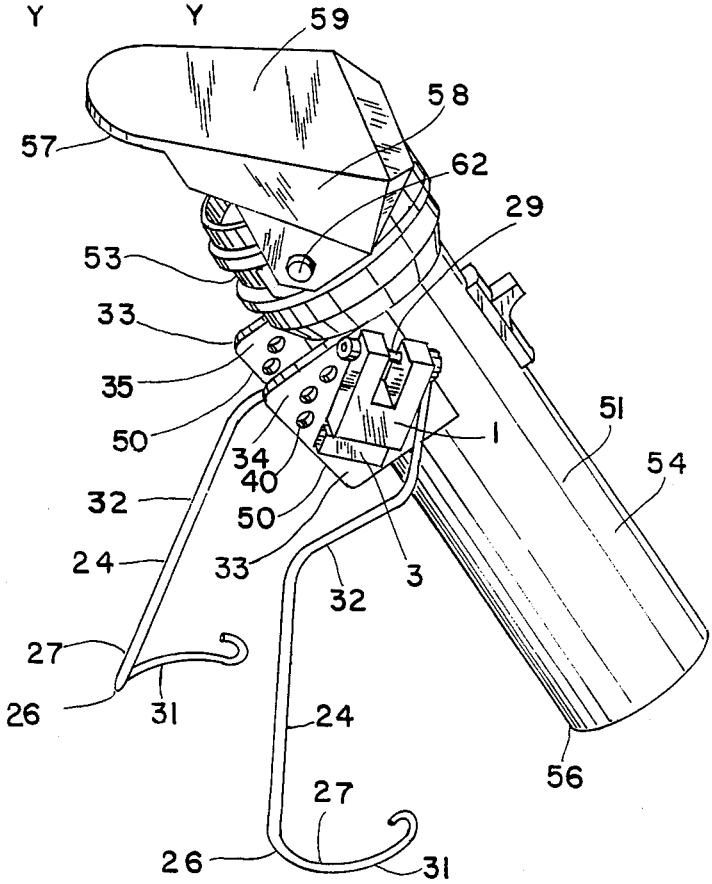
FIG. 2 is a perspective view of the invention in the nominal tripod position, with the reflector deployed for use.

This invention provides many positions of operation, as shown in FIGS. 1 through 9, which should provide device support, or suspension, in almost any situation. FIG. 1 shows the standard hand held position, or stow position, when the legs are latched against the device casing and the reflector is latched between the flanges. The leg stow position is attained by rotating the legs to position AM. FIG. 2 shows the nominal tripod position, leg position CN, where the two legs and the device casing effectively constitute three legs of a tripod. Of course, other tripod positions are attainable, such as positions BN, BO and CO, which offers other leg angles, but still in the tripod configuration. The significance of the nominal tripod position is that the tripod support section (31) portion of the hooking means (27) is designed such that it is in almost full contact with a flat supporting surface, providing the legs a larger "snowshoe" type supporting area.

The tripod support capability provides one of the outstanding features of the instant invention. The device may be assembled on irregular terrain and still works satisfactorily. Basically, all that is needed is three isolated points on which to place the legs and casing. A flat surface of any type is not required. Thus, the instant invention may be placed, for example, inside an automobile hood with one leg on the engine, one leg on the distributor and the casing on the carburetor. Furthermore, on extremely sloped or steeped surfaces, a very stable tripod position may be obtained by rotating the legs to position FN, for example, as shown in FIG. 5*b*, thus increasing the distance between the legs and casing and lowering the device center of gravity. An additional adaptability of the tripod position is that the distance between the two legs can be varied, as shown in FIG. 9. Detent position CN is the stance provided by the nominal tripod. Suppose, for example, that the only available surface is a 2×4 beam. In that case, the legs could be rotated, to a much more narrow position CM. Or, if rotated to a wider stance CO, a more stable tripod is established. Another advantage of the tripod position is that it raises the light emitting source above objects that would block the light beam, such as grass, rocks, etc.

Another important advantage of the tripod position results from the fact that much, if not most, work is performed while we look down into the work area, such as when we write, change spark plugs, change washers in the kitchen faucet, etc. The tripod position provides the ideal support for this type of activity in that it raises the reflector above the work area, as shown in FIG. 2. In this position, the illuminating device makes an excellent high intensity light for extremely detailed work, like splinter removal, etc.

Another important feature of this invention is that each leg has two separate axes of rotation, allowing the legs to be rotated to almost any position. Furthermore, each leg is independent of the other, providing even more flexibility in leg positioning. Another advantage of leg independence is that the legs can be electrically isolated from each other, providing a much safer support in an electrical environment.

The two axis rotational capability of each leg provides support positions other than a tripod. For example, as shown in FIG. 8, the legs could be positioned tangential to the casing by rotating them to Position AP, providing support over a crevice.

The fact that the legs may be rotated 360° on the Z axis and about 180° on the Y axis provides a great degree of ruggedness in that an accidental movement of the legs will usually result in nothing more than a continual of rotation, and not breakage.

A very important feature of this device support is that it provides a means to suspend, or hang, the device onto some object in a manner somewhat similar to that of a mechanic's trouble light. As shown in FIGS. 1, 2, 6, 7, 10 and 12, a hooking means (27) is formed into the end of the leg. Only one leg needs to be deployed as shown in FIG. 7. Here, the leg is shown in the extended reach position JR. The device may be rotated, on the Z axis, to other positions, A through L, to obtain any Z axis orientation required for proper illumination. Or, both legs may be deployed for greater stability, as shown in FIG. 6. Advantages of the hanging capability are numerous. There are occasions when no suitable surface is available for device support, but objects of suspension potential are. In some cases, the quality of a suspended light source is superior. For example, a camper pitching a tent at night would find the general area better illuminated if the device was hung from a tree branch rather than placed on the ground. Another advantage is that it allows the light source to be suspended above and out of the way of the work area. A mechanic could hang the device on the car hood latch and work without fear of hitting the device with a tool.

The fact that this invention will serve an illuminating device not equipped with an adjustable reflector (since the reflector is not deployed) is seen in FIGS. 5*a*, 5*b* and 5*c* where incremental elevation positions of about 45° below the horizontal (FIG. 5*a*) to about 60° above the horizontal (FIG. 5*c*) are provided.

Another position of illuminating device support is shown in FIGS. 4*a* and 4*b*, where the flanges (33) and the casing rear end (56) form a three point support, hereby defined as the flange support position. In this position, the legs are not needed and are not deployed. Note that the reflector mechanism is maintained high enough above the surface to allow reflector usage. This position fulfills many illumination requirements and is very handy from the standpoint that no time is required to deploy the legs, and furthermore, can be used in areas where space is too restricted to allow room for leg deployment.

An alternative form of the instant invention is suggested by FIGS. 4*a* and 4*b*, and is shown explicitly in FIGS. 23, 24*a*, 24*b* and 25. In this form, the legs (24) and rotors (1) are dispensed with and the only support offered is the two flanges (65)and the casing rear end (56), providing a flange support position. Even though the advantages provided by the legs are eliminated, this version, in combination with the adjustable reflector, provides a very effective illuminating device, capable of reflecting light into almost any direction. A great advantage of the alternative form is that it would be less expensive to produce and sell than the main form of the instant invention. The flanges in the alternative form have reflector latching means (69) for the same reasons as the main form.

The three main elements of the preferred embodiment of the instant invention are the flanges (33), rotors (1) and the legs (24). Observing FIGS. 1, 2 and 14, it can be seen that the flanges are attached to either side of the device casing (54) and extend downward.(assuming the device is so oriented that the W axis is horizontal) and terminate in a flange botton edge (50). Each flange has an inside surface (35) and an outside surface (34), as shown in FIGS. 10, 12 and 14, wherein the said outside surface would be the visible side of the nearest flange in a side view of the device. Each flange is arranged generally opposite the other, and the flanges are located substantially forward of the casing rear end (56), but somewhat rearwards of the point on the casing where the reflector is attached, wherein in the preferred embodiment, the reflector point of attachment would be the collar means receiver (53). The flanges are sufficiently spaced apart and configured to allow reception of the reflector hood (58), between the flange inside surfaces, as the reflector is moved, or adjusted, into a stored, or unused position. The flanges also have a reflector latching means (36) (see FIGS. 10, 14 and 15*a*) to latch the reflector into the said stored position. As shown in FIGS. 4*a* and 4*b*, the flanges are so located on the casing, relative to the device center of gravity, that a stable device support position is attained when the two flange bottom edges (50) and a point on, or near, the casing rear end (56) contacts a flat, horizontal surface, providing a support position hereby defined as the flange support position, wherein the distance the flange bottom edges extends downward from the casing is sufficient to hold the casing front end (55) high enough above the supporting flat surface to allow the adjustment and use of the reflector.

The flange contains a rotor shaft bearing (49), or hole, as shown in FIGS. 10, 14 and 18. The rotor shaft bearing rotatably receives the rotor shaft (11), providing the rotor with 360° of rotation on the Z axis, wherein the Z axis is established by the said rotor shaft bearing. The Z axis is oriented such that it may either intersect the W axis in a generally perpendicular fashion, or be displaced away from the W axis in such a fashion that a plane would exist that would both contain the Z axis and also intersect the W axis in a generally perpendicular fashion.

In the preferred embodiment, as shown in FIG. 18, the flange contains twelve protrusion receivers, namely protrusion receiver A (37), B (38), C (39), D (40), E (41), F (42), G (43), H (44), I (45), J (46), K (47) and L (48), wherein the said twelve protrusion receivers are holes, or notches, made through or onto the said flange outside surface, respectively, wherein the said protrusion receivers are arranged in a concentric fashion around the rotor shaft bearing and are about 30° apart, relative to the Z axis. The protrusion receivers receive the wiper arm protrusion (4), which is attached, through the wiper arm, to the rotor (1). In the preferred embodiment, the protrusion (4) is tapered, or rounded, to allow a camming action in or out of its various receivers. The twelve protrusion receivers, in cooperation with the rotor wiper (3) wiper arm protrusion (4) and wiper arm spring means (21) provides the rotor, and ultimately, the leg, with a Z axis position holding means, providing twelve detent positions about 30° apart. The twelve protrusion receivers A through L (37 through 48) provides the twelve Z axis detent positions A through L respectively, as shown in FIG. 11*a*. As previously discussed, these are rather arbitrary angles and the number of protrusion receivers also being rather arbitrary, and in no way can this invention be considered restricted to that exact number of receivers or angular spacing.

The reflector latching means (see FIGS. 12, 14 and 15*a*) comprises flanges being constructed of material having spring-like characteristics, wherein rounded protrusions (36) are made onto the flange inside surfaces and configured such that when the reflector is moved in between the inside surfaces, the protrusions contacts the reflector, forcing the flanges apart beyond their natural state, and as the movement of the reflector continues in the same direction, into a stored position, the reflector passes the salient point of the rounded protrusions and the flanges then began returning back to their natural state, resulting in latching the reflector between the flange inside surfaces.

As shown in FIGS. 10 and 17 the rotor has a main body (2), a top prong (5) and a bottom prong (6), said prongs attached to the main body and extending away in a manner to effectively form a fork. The main body has an inside surface (10), said surface lying generally in a plane, wherein a rotor shaft (11) is made onto the said rotor inside surface and extends away in a manner generally perpendicular to the said plane of the rotor inside surface. The rotor shaft is rotatably received by the rotor shaft bearing (49), resulting in the rotatable interfacing of the rotor inside surface (10) and the flange outside surface (34), wherein a rotor shaft retaining means (12) retains the rotor shaft within the rotor shaft bearing. The rotor rotates on the Z axis and has Z axis position holding means whereby the rotor, and leg, may be rotated to a particular position on the Z axis, and that position retained.

The distance between the rotor inside surface and outside surface (9) should be kept to a minimum in order to not increase the overall size of the device significantly.

In the preferred embodiment, the Z axis position holding means comprises of a wiper arm (3) attached, on one end, to the rotor main body and having, on its opposite end, a wiper arm protrusion (4), said wiper arm and protrusion being configured such that the said protrusion engages the protrusion receivers located on the flange outside surface, wherein a wiper arm spring means (21) forces the said protrusion into engagement with the said protrusion receivers, providing the rotor, and ultimately the leg, with twelve detent positions on the Z axis.

In the preferred embodiment, the wiper arm spring means is comprised of a wiper arm being constructed of material having springlike characteristics, wherein the wiper arm is configured such that when the wiper arm protrusion is engaged with a protrusion receiver, the wiper arm is forced out of its natural state, resulting in a force that forces the wiper arm protrusion into engagement with the said receiver. FIGS. 19 and 20 show the wiper arm protrusion engaged with a protrusion receiver, placing the rotor in a Z axis detent position. Notice, in FIGS. 21 and 22, that as the rotor is rotated out of a detent position, the wiper arm is forced even further out of its natural state, creating a requirement for increased rotational force on the rotor, and leg, to move the said protrusion out of protrusion receiver. This requirement for increased force, of course, provides the Z axis position holding means.

The rotor top prong (5) contains a leg shaft top bearing (7), or hole, and the bottom prong contains a leg shaft bottom bearing (8), or hole, wherein both the said leg shaft bearings are in alignment and establish the Y axis and rotatably receive the leg shaft (29), providing the leg (24) with about 180° of rotational capability on the said Y axis. In the preferred embodiment, the said prongs and leg shaft bearings are configured such that the Z axis and the Y axis are displaced apart but relatively oriented such that a plane would exist that will both contain the Y axis and also intersect the Z axis in a generally perpendicular manner.

In the preferred embodiment, as shown in FIG. 17, the top prong top surface (13) has made thereonto a raised surface (23), said raised surface arranged in a generally semi-circular fashion around the leg shaft top bearing (7), said raised surface containing a leg cam M (15) and five leg grooves, namely leg groove N (16), O (17), P (18), Q (19) and R (20) wherein the said leg cam and five leg grooves, in cooperation with the leg shaft (29), leg contact area (28) leg shaft retaining means (30) and the leg spring means (22) provides the legs with a Y axis position holding means.

The leg, as shown in FIGS. 10, 12 and 13, includes the leg shaft (29), first bend (25), extension section (32) and hooking means (27). The leg shaft is made onto one end of the extension section, and the hooking means onto the opposite end. The first bend provides the intersection for the joining of the leg shaft with the extension section, said first bend forming an angle of about 90°. In the preferred embodiment, the hooking means is comprised of the extension section, second bend (26) and tripod support section (31) wherein the second bend provides the intersection for the joining of the extension section to the tripod support section, said second bend forming an angle that is less than 90° as shown in FIG. 12. The second bend creates an angle between the extension section and the tripod support section that not only provides an angle for hooking, but also provides the angle necessary to allow most, if not all, of the tripod support section to contact a flat supporting surface when the device is placed into the nominal tripod position. This is to say that, when the legs are rotated to position CN, establishing the nominal tripod position, as shown in FIGS. 2, **5*c* and 9**, the angle of the second bend is such, and the shape of the tripod support section is such, that most, if not all, of the tripod support section will contact the supporting surface. The tripod support section serves to provide a larger area, or "snow shoe" type, supporting function for the device when the device is used on a soft surface, such as mud, slush, or the like.

The leg shaft is received by the leg shaft top and bottom bearings and is retained within the said bearings by a leg shaft retaining means (30). The leg has a rotational range of about 180° on the Y axis said rotational range being limited by the leg encountering some part of the device, casing or flange. The leg has Y axis position holding means whereby the leg may be rotated to a particular position on the Y axis, and that position retained.

In the preferred embodiment, the leg contact area (28), which is located on the extension section adjacent the leg shaft, engages the rotor raised surface and its contained leg cam M, and leg grooves N, O, P, Q and R which, in turn said cam and grooves provides the leg Y axis positions M, N, O, P, Q and R respectively. A leg spring means (22) forces engagement of the contact area with the raised surface. As seen in FIG. 17, starting with the leg cam M, which is adjacent the rotor inside surface, and continuing clockwise, leg grooves N (16), O (17), P (18), Q (19) and R (20) are encountered by the rotating contact area. The leg cam M (15) lowest elevation point, above the top prong top surface, is adjacent the rotor inside surface, and provides increased elevation as the contact area approaches leg groove N. When the contact area is engaged with leg cam M, the leg spring means urges a rotation of the leg in a direction towards the lowest point of leg cam M, wherein leg rotation ceases when the leg comes into contact with the device, casing or flange, thereby providing the leg with the Y axis position M. The leg cam M provides the narrowest leg stance, as seen in FIG. 9. As seen in FIG. 14, leg cam M holds the legs in the stow Position, leg position AM, urging the leg against the device casing. It should also be noticed that in the stow position, the leg is shaped to conform to the shape of the device, and that the leg contains bends other than the first and second bends, to provide this function. In the preferred embodiment, as seen in FIG. 11*b*, assuming that the leg Y axis angle is 0° when in the stow position M, the five leg grooves are located on the raised surface to provide the following Y axis leg angles: leg groove N about 20°, leg groove 0 about 40°, leg groove P about 90°, leg groove Q about 160° and leg groove R about 180°. As previously discussed, these are rather arbitrary angles and leg groove. numbering and in no way is this invention to be considered restricted to this exact number of leg grooves, or angular spacing.

As with the leg cam M, the leg spring means forces the contact area into engagement with the five leg grooves, creating a requirement for increased force on the leg, on the Y axis, to disengage the contact area from the said leg grooves, thereby providing the leg with a Y axis position holding means. This action is shown explicitly in FIGS. 16*a* and 16*b*. In FIG. 16*a*, the leg contact area is resting in groove R. In FIG. 16*b*, as the leg is rotated out of groove R, the top and bottom prongs are forced closer together, requiring increased torque on the leg.

In the preferred embodiment a leg spring means is comprised of a rotor constructed of material having spring-like characteristics, wherein the leg shaft top bearing and leg shaft bottom bearing are located on the top prong and bottom prong, respectively, said locations being a substantial distance from where each prong is attached to the rotor main body, a leg shaft retaining means installed on that portion of the leg shaft that extends beyond the bottom prong bottom surface (14) in such a fashion that the said retaining means contacts the bottom prong bottom surface and, in cooperation with the leg contact area, furthermore forces the top prong and bottom prong closer together than their natural state, resulting in a spring-like force that forces the leg contact area into contact with the raised surface and its included leg cam M and leg grooves N through R .

It can be seen in FIGS. 12, 14 and 15*a*, that when the legs are in stow position, the Y axis is more forward of the Z axis leg a distance S. The rotor is so oriented, and the relative positions of the Y axis to the Z axis are such that, during the stow period, the smallest distance S, between the Y and Z axes can be measured on a line that generally perpendicularly intersects both the Y and Z axes, said line also being generally parallel to the device W axis, so that if the leg is rotated about 180° on the Y axis, out of the stow position, then the distance from a given point on the hooking means to the Z axis would increase about 2 S, thereby providing the legs with an extended reach, or an extended reach position.

In the preceeding discussions, the relative orientation of the Y and Z axes were described as one where a plane exists that would contain one axis and perpendicularly intersect the other. Actually, the main consideration is that two seperate, different, non-parallel and non-coincident axes be provided for leg movement. The advantages of two axes leg rotation would still exist even if the previous description was deviated from by a significant degree. The advantages would only cease when the two axes were either parallel or coincident. This being the case, this invention is not limited to the previous exact Y and Z axes orientation description. Obviously, there are many other ways a Y axis and a Z axis position holding means could be designed other than that used in the preferred embodiment. It would appear, at first glance, that a friction type holding means, where the rotor shaft and leg shaft are friction fitted into their respective bearings, would be the simplest and cheapest design. In reality, however, this would either require extreme manufacturing tolerances, which is undesirable, or extra parts, such as rubber O rings or grommets, which is also undesirable. Also, longivity and dependability are compromised because friction fitted parts become loose with wear, losing their holding capability. From an operational standpoint, the infinite positioning offered by a friction fitted holding means is less desirable than the finite, or detent, type, as previously discussed. Actually, the preferred embodiment detent design requires no extra parts, or extreme manufacturing tolerances. The wiper arm, protrusion, leg spring means and wiper arm spring means, or portions thereof, are all an integral part of the rotor, and all, including the rotor, can be plastic molded as one part. The protrusion receivers require only a modification to the flanges. The contact area exists in the leg, already, as a result of inherent design. In addition, the incorporation of the position holding means into the three main elements of the invention does not significantly increase or alter their size or shape. In brief, the design of the Y and Z axis position holding means utilized in the preferred embodiment requires no extra parts, is rugged and dependable, easily assembled, cheap, compact and requires no extreme manufacturing tolerances.

It is noteworthy to mention that the leg cam M and the leg grooves N through R could all be made directly into the top prong top surface rather than being made part of the raised surface. The raised surface configuration is simply one method of actual construction and presented an easy way to refer to those parts without having to list them individually in every reference.

The main element of the alternative form of the instant invention, shown in FIGS. 23, 24*a*, 24*b* and 25 are the flanges (65). The flanges are attached to either side of the device casing (54) and extend downward (assuming the device is so oriented that the W axis is horizontal) and terminate in a flange bottom edge (68). Each flange has an inside surface (66) and an outside surface (67), wherein the said outside surface would be the visible side of the nearest flange in a sideview of the device, as shown in FIG. 24*a*. Each flange arranged generally opposite the other, and the flanges are located substantially forward of the casing rear end (56), but somewhat rearwards of the point on the casing where the reflector (57) is attached, as shown in FIG. 25. The flanges are sufficiently spaced apart and configured to allow reception of the reflector hood (58), between the inside surfaces, as the reflector is moved, or adjusted, into a stored, or unused, position. The flanges also have a reflector latching means (69) to latch the reflector into the stored position. The flanges are so located on the casing, relative to the device center of gravity, that a stable device support position is attained when the flange bottom edges and a point on, or near, the casing rear end (56) contacts a flat horizontal surface, wherein the distance the flange bottom edges extend downward from the casing is sufficient to hold the casing front end (55) high enough above the supporting surface to allow the unencumbered adjustment and use of the reflector when the device is in the said support position, as shown in FIGS. 24a and 24b. This position, of course, is the same position previously described in the main form as the flange support position.

As shown in FIGS. 23, 24a and 25, the flanges are located sufficiently forward the casing rear end (56) to allow the casing to be grasped by the hand on that portion of the casing rearwards of the flanges which, of course, allows the hand held mode of operation.

What is claimed is:

1. An illuminating device support for illuminating devices having an adjustable light reflector, said devices also having a casing and a light emitting source, the said reflector and light emitting source being located generally on the casing front end, wherein the reflector may be employed to adjustably reflect light emanating from the said light emitting source, the said casing having a longitudinal axis, W, that extends through the casing front end and rear end, comprising:

(a) flanges attached to either side of the casing and extending downward, assuming the device is so oriented that the W axis is horizontal, and terminating in a flange bottom edge, said flanges having an inside surface and an outside surface, wherein the said outside surface would be the visible side of the nearest flange in a side view of the device, each said flange being arranged generally opposite the other, said flanges being located substantially forward of the casing rear end but somewhat rearwards of the area on the casing where the reflector is attached, said flanges being sufficiently spaced apart and configured to allow reception of the reflector, between the flange inside surfaces, as the reflector is adjusted, or moved, to a stored, or unused, position, wherein the flanges have a reflector latching means to latch the reflector into the said stored position, wherein the flanges are so located on the casing, relative to the center of gravity of the device, that a stable device support position is attained when the bottom edges of the flanges and a point on, or near, the device rear end contact a horizontal flat surface, said support position hereby defined as the flange support position, wherein the distance the flange bottom edges extends downward from the casing is sufficient to hold the casing front end high enough above a supporting surface to allow adjustment and use of the reflector when the device is in the said flange support position, wherein the said flange contains a rotor shaft bearing, or hole, said rotor shaft bearing establishing a Z axis and receiving a rotor shaft, providing a rotor with 360° of rotation on the said Z axis, wherein the Z axis may either intersect the W axis in a generally perpendicular fashion, or be displaced away from the Z axis in such a fashion that a plane would exist that would both contain the Z axis and also intersect the W axis in a generally perpendicular fashion; and (b) rotors having a main body and a top prong and a bottom prong, said prongs attached to the main body and extending away in a manner to effectively form a fork, said main body having an inside surface, said inside surface lying generally in a plane, wherein a rotor shaft is made onto the said inside surface and extends away in a manner generally perpendicular to the said plane of the inside surface, wherein the rotor shaft is rotatably received by the rotor shaft bearing, resulting in the rotatable interfacing of the rotor inside surface with the flange outside surface, whereby a rotor shaft retaining means retains the rotor shaft within the said rotor shaft bearing, wherein the rotor rotates on the Z axis and has Z axis position holding means whereby the rotor may be rotated on the Z axis to anyone of several various positions within the rotor's 360° rotational range and that position retained, wherein the top prong contains a leg shaft top bearing, or hole, and the bottom prong contains a leg shaft bottom bearing, or hole, wherein both said leg shaft bearings are in alignment and establish the Y axis and rotatably receive the leg shaft, providing the leg with rotational capabilities on the said Y axis, wherein, since the rotor rotates on the Z axis, and the Y axis also rotates on the Z axis, the leg, then, has rotational capabilities on both the Y and Z axes, wherein the said prongs and leg shaft bearings are configured such that the Z axis and Y axis are displaced apart but relatively oriented such that a plane would exist that would both contain the Y axis and also intersect the Z axis in a generally perpendicular manner; and (c) legs having a leg shaft on one end and a hooking means on the opposite end, and an extension section connecting the said leg shaft to the said hooking means, wherein the leg shaft and extension section join, or intersect, at an angle of about 90°, said angular intersection hereby defined as the first bend, wherein the leg shaft is rotatably received by the leg shaft top bearing and leg shaft bottom bearing, providing the leg with a rotational range of about 180° on the Y axis, said leg Y axis rotational range limits occurring when the leg encounters some portion of the illuminating device or flange, wherein the leg has Y axis position holding means whereby the leg may be rotated to any one of several positions within the said leg's Y axis rotational range and that position retained, wherein the rotor and flange, in combination, provides the legs with both 360° rotational capability on the Z axis and also a Z axis position holding means.

2. The device support of claim 1 wherein the Z axis position holding means is comprised of a wiper arm having a rounded or tapered protrusion made onto one end, said wiper arm attached to the rotor main body on the other end, the said wiper arm and protrusion configured to engage any one of several protrusion receivers, a said protrusion receiver being a hole, or notch, wherein a wiper arm spring means forces the said protrusion into engagement with the protrusion receivers, said protrusion receivers being made onto the outside surface of a flange and arranged generally equidistant from the rotor shaft bearing, wherein the protrusion receivers and wiper arm and wiper arm protrusion act cooperatively to provide the rotor, and attached leg, with rotational detent positions on the Z axis by creating a requirement for increased force on the said rotor or leg to disengage the wiper arm protrusion from a protrusion receiver.

3. The device support of claim 2 wherein a wiper arm spring means in comprised of a wiper arm constructed of material having spring-like characteristics, said wiper arm being configured such that when the wiper arm protrusion is engaged with any one of several protrusion receivers, the wiper arm is forced out of its natural state, resulting in a spring-like force that forces the wiper arm protrusion into engagement with the said protrusion receiver.

4. The device support of claim 1 wherein the Y axis position holding means is comprised of a raised surface made onto the top prong top surface, said raised surface being arranged in a generally semi-circular fashion around the leg shaft top bearing, said raised surface containing, or including, a leg cam and several leg grooves, wherein the leg includes a leg contact area, said contact area being a portion of the leg extension section that is located adjacent the first bend, wherein the contact area engages the raised surface as the leg is rotated through its rotational range of 180°, wherein a leg spring means forces engagement of the contact area with the raised surface, wherein the leg cam's lowest elevation portion, above the said top prong top surface, is adjacent the rotor inside surface, and provides increased elevation to the moving contact area as the said contact area moves away from the rotor inside surface and approaches the firat encounterable leg groove, wherein a leg spring means and leg cam, in cooperation, urge a leg rotation in a direction towards the lowest portion of the leg cam when the said contact area is engaged with the said leg cam, wherein the said rotation ceases when the leg comes into contact with some portion of the illuminating device, casing or flange, thereby providing the leg with one held, or detent, position on the Y axis, wherein each leg groove, in cooperation with the leg spring means, provides the leg with additional held, or detent positions on the Y axis by forcing a requirement for increased force on the legs to disengage the leg contact area from that leg groove.

5. The device support of claim 4 wherein a leg spring means is provided by a rotor constructed of material having spring-like characteristics wherein the leg shaft top bearing and the leg shaft bottom bearing are located on the top prong and bottom prong, respectively, said bearing locations being a substantial distance from where each said prong is attached to the rotor main body, wherein a leg shaft retaining means is installed in such a fashion on that portion of the leg shaft that extends beyond the bottom prong bottom surface that the said retaining means contacts the bottom prong bottom surface and, in cooperation with the leg contact area, furthermore forces the top prong and the bottom prong closer together than their natural state, resulting in a spring-like force that forces the leg contact area into engagement with the raised surface and its included leg cam and leg grooves.

6. The device support of claim 1 wherein a hooking means is comprised of a leg extension section and a tripod support section, said extension section and tripod support section joining, or connecting, at an angle of less than 90°, wherein the said angle is hereby defined as the second bend, wherein the said tripod support section is connected to the extension section end that is opposite the extension section end that is connected to the leg shaft, wherein the exact angle of the second bend and the shape of the tripod support section are determined by the resulting geometric configuration of the legs and the device casing when the device is placed into the nominal tripod position, said nominal tripod position being defined as an arbitrarily chosen set of exact leg positions on the Y and Z axes wherein the two legs and the device casing effectively form a tripod that may support the device on a horizontal flat surface, wherein the second bend angle and the shape of the tripod support section are such that most, if not all, of the tripod support section will contact the said surface supporting the device when the device is in the said nominal tripod position, wherein Y axis and the Z axis position holding means hold the legs in the nominal tripod position.

7. The device support of claim 1 wherein the legs may be rotated to a stow position, said legs being held in the stow position by the Y axis and Z axis position holding means, said stow position being defined as that position where the legs extend from the rotor towards the casing rear end, in a direction generally parallel to the W axis, said legs being held closely to the device casing, wherein the legs are shaped to closely conform to the shape of the casing, wherein during the said stow position period, the Z axis is more forward than the Z axis, wherein a line exists, during said stow period, that is generally parallel to the W axis wherein the said line also intersects both the Y and Z axes in a generally perpendicular manner, wherein the distance between the Y and Z axes may be measured on the said line, such that if the leg is rotated about 180° on the Y axis, out of the stow position, then the distance from a given point on the hooking means to the Z axis would increase a distance equal to about twice the distance between the Y and Z axes, thereby providing the legs with an extended reach.

8. The device support of claim 1 wherein the reflector latching means comprises of flanges constructed of material having spring-like characteristics wherein rounded protrusions are made onto the flange inside surfaces, said protrusions being configured such that when the reflector is moved in between the said inside surfaces, the protrusions contact the reflector, forcing the flanges apart beyond their natural state, wherein as movement of the reflector continues in the same direction until the reflector is past the salient point of the protrusions, the flanges begin returning back to their original state, resulting in latching the reflector between the flange inside surfaces.

* * * * *